US008052811B2

(12) United States Patent
Kurosaki et al.

(10) Patent No.: US 8,052,811 B2
(45) Date of Patent: Nov. 8, 2011

(54) METHOD OF PRODUCING NON-ORIENTED ELECTRICAL STEEL SHEET EXCELLENT IN MAGNETIC PROPERTIES

(75) Inventors: Yousuke Kurosaki, Tokyo (JP); Takeshi Kubota, Tokyo (JP); Masafumi Miyazaki, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 117 days.

(21) Appl. No.: 12/311,726

(22) PCT Filed: Oct. 1, 2007

(86) PCT No.: PCT/JP2007/069531

§ 371 (c)(1),
(2), (4) Date: Apr. 9, 2009

(87) PCT Pub. No.: WO2008/050597

PCT Pub. Date: May 2, 2008

(65) Prior Publication Data

US 2009/0250145 A1 Oct. 8, 2009

(30) Foreign Application Priority Data

Oct. 23, 2006 (JP) ..... 2006-287504
Feb. 22, 2007 (JP) ..... 2007-041809

(51) Int. Cl.
*C21D 8/04* (2006.01)
*H01F 1/00* (2006.01)

(52) U.S. Cl. ..... 148/546; 148/306; 148/307

(58) Field of Classification Search ..... 148/306, 148/307, 547, 546
See application file for complete search history.

(56) References Cited

U.S. PATENT DOCUMENTS 5,484,009 A * 1/1996 Love et al. ..... 164/429
2001/0037841 A1* 11/2001 Murakami et al. ..... 148/306
2003/0024606 A1* 2/2003 Hayakawa et al. ..... 148/307

FOREIGN PATENT DOCUMENTS

JP 51-062115 5/1976

(Continued)

OTHER PUBLICATIONS

International Search Report dated Nov. 13, 2007 issued in corresponding PCT Application No. PCT/JP2007/069531.

(Continued)

*Primary Examiner* — Kiley Stoner
*Assistant Examiner* — Alexander Polyansky
(74) *Attorney, Agent, or Firm* — Kenyon & Kenyon, LLP

(57) ABSTRACT

A rapidly-solidified non-oriented electrical steel sheet having high magnetic flux density and low core loss is provided. The method of producing the non-oriented electrical steel sheet excellent in magnetic properties comprises casting a steel strip by using a traveling cooling roll surface(s) to solidify a steel melt of a prescribed chemical composition, which melt contains one or both of REM and Ca at a total content of 0.0020 to 0.01% and is cast in an atmosphere of Ar, He or a mixture thereof.

1 Claim, 1 Drawing Sheet

FOREIGN PATENT DOCUMENTS

| | | | |
|---|---|---|---|
| JP | 58-81951 | | 5/1983 |
| JP | 58-081951 | | 5/1983 |
| JP | 62-240714 | | 10/1987 |
| JP | 04-367353 | | 12/1992 |
| JP | 4-367353 | | 12/1992 |
| JP | 05-306438 | | 11/1993 |
| JP | 06-306467 | | 11/1994 |
| JP | 08-003699 | | 1/1995 |
| JP | 8-3699 | | 1/1996 |
| JP | 09125145 A | * | 5/1997 |
| JP | 2003-27193 | | 1/2003 |
| JP | 2003-027193 | | 1/2003 |
| JP | 2004-323972 | | 11/2004 |
| JP | 2004-339537 | | 12/2004 |
| JP | 2005-298876 | | 10/2005 |

OTHER PUBLICATIONS

Japanese Office Action mailed Aug. 31, 2010 in Japanese Application No. 2007-041809 (English translation of Office Action).

* cited by examiner

METHOD OF PRODUCING NON-ORIENTED ELECTRICAL STEEL SHEET EXCELLENT IN MAGNETIC PROPERTIES

FIELD OF THE INVENTION

This invention provides a production method for obtaining a non-oriented electrical steel sheet high in magnetic flux density and low in core loss.

DESCRIPTION OF THE RELATED ART

Non-oriented electrical steel sheet is used in large generators, motors, audio equipment, and small static devices such as stabilizers. A need therefore exists for non-oriented electrical steel sheet excellent in magnetic properties, namely, that is high in magnetic flux density and low in core loss.

One method for producing non-oriented electrical steel sheet high in magnetic flux density is the rapid solidification process. In this method, a steel melt is solidified on a travelling cooling surface to obtain a cast steel strip, the steel strip is cold-rolled to a predetermined thickness, and the cold-rolled strip is finish-annealed to obtain a non-oriented electrical steel sheet. Japanese Patent Publication (A) Nos. S62-240714, H5-306438, H6-306467, 2004-323972, and 2005-298876 teach methods of producing non-oriented electrical steel sheets of high magnetic flux density by the rapid solidification process.

On the other hand, when fine precipitates are present, they degrade core loss property by, for example, inhibiting crystal grain growth during finish-annealing and hindering magnetic domain wall motion during the magnetization process. The method generally used to inhibit precipitation of fine AlN formed when N is present is to add Al to a content of 0.15% or greater. As a method for controlling fine sulfides, Japanese Patent Publication (A) No. S51-62115, for example, teaches fixation of S by addition of rare earth metals (REM).

SUMMARY OF THE INVENTION

In light of the desire to conserve energy and resources, a need has arisen for steel sheet that is high in magnetic flux density and low in core loss. Although high magnetic flux density can be achieved by the rapid solidification processes taught in the aforesaid Japanese Patent Publication (A) Nos. S62-240714, H5-306438, H6-306467, 2004-323972, and 2005-298876, the steels sheets obtained are unsatisfactory in the point of low core loss. Moreover, the method taught by Japanese Patent Publication (A) No. S51-62115 uses REM to control sulfides and is incapable of achieving satisfactory magnetic flux density.

The present invention provides a method of producing a non-oriented electrical steel sheet of high magnetic flux density and low core loss unattainable by the methods of the prior art. The gist of the invention is as set out below:

(1) A method of producing non-oriented electrical steel sheet excellent in magnetic properties comprising:

obtaining a cast steel strip by using a traveling cooling roll surface(s) to solidify a steel melt comprising, in mass %, C: 0.003% or less, Si: 1.5 to 3.5%, Al: 0.2 to 3.0%, 1.9%≦(Si %+Al %), Mn: 0.02 to 1.0%, S: 0.0030% or less, N: 0.2% or less, Ti: 0.0050% or less, Cu: 0.2% or less, T.O: 0.001 to 0.005%, and a balance of Fe and unavoidable impurities, cold-rolling the cast steel strip, and then finish-annealing it, wherein the steel melt has a total content of one or both of REM and Ca of 0.0020 to 0.01% and is cast in an atmosphere of Ar, He or a mixture thereof.

(2) A method of producing non-oriented electrical steel sheet excellent in magnetic properties according to (1), wherein the steel melt has a total content of one or both of Sn and Sb of 0.005 to 0.3%.

DETAILED DESCRIPTION OF THE INVENTION

Figure 1:
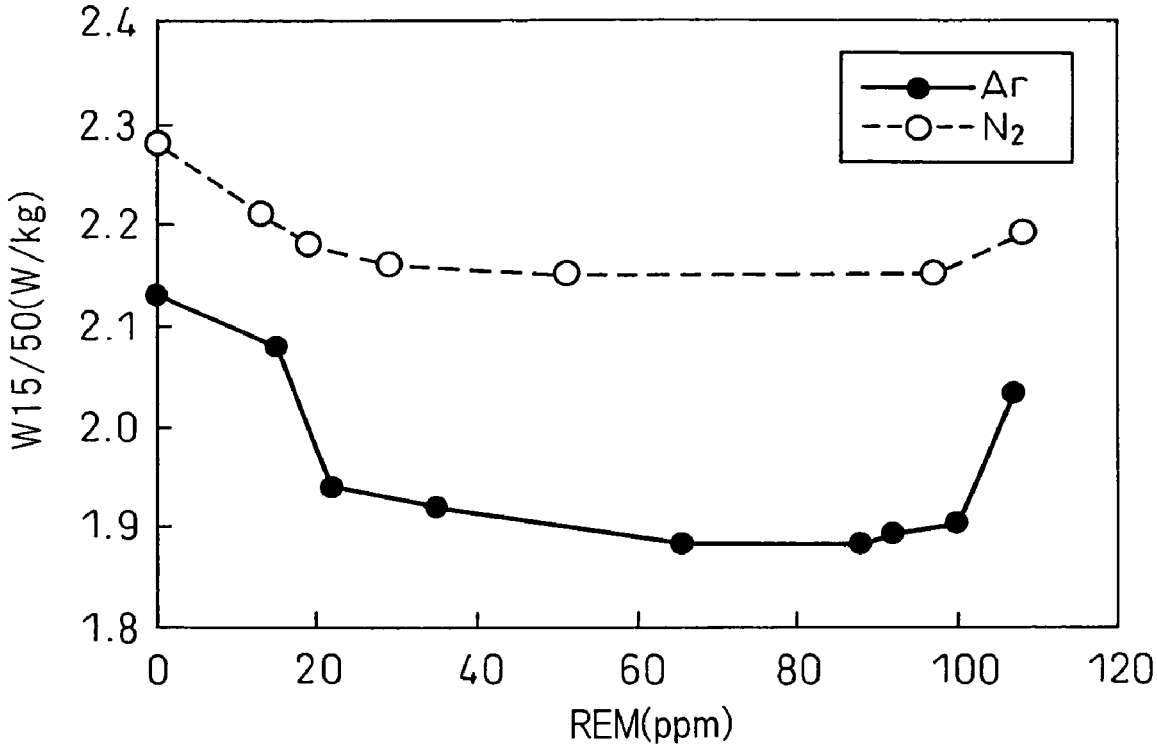
FIG. 1 is a diagram showing how W15/50 varies with REM content and casting atmosphere.

The present invention is explained in detail in the following.

The inventors carried out an in-depth study aimed at the development of a method of producing a non-oriented electrical steel sheet that is high in magnetic flux density and low in core loss. As a result, they learned that in the rapid solidification process it is highly effective to define the steel melt content of one or both of REM and Ca as a total of 0.0020 to 0.01% and the casting atmosphere as Ar, He or a mixture thereof.

Now follows the results of experiments conducted by the inventors. The inventors prepared a 2.0-mm thick cast strip by using the twin-roll process to rapidly solidify a steel melt containing C: 0.0012%, Si: 3.0%, Al: 1.4%, Mn: 0.24%, S: 0.0022%, N: 0.0023%, Ti: 0.0015%, Cu: 0.09% and T.O: 0.0030% in an $N_2$ casting atmosphere. The result was cold-rolled to a thickness of 0.35 mm and subjected to 1050° C.×30 s finish-annealing in a 70% $N_2$+30% $H_2$ atmosphere. Precipitates in the finish-rolled sheet were examined with an electron microscope. AlN of micron size and Mn—Cu—S in the approximate size range of several tens of nanometers to one hundred nanometers were observed. AlN was very abundant. The cast strip and finish-annealed sheet were therefore analyzed for N. It was found that while the N concentration of the melt was 23 ppm, the cast strip and the finish-annealed sheet both had an N concentration of 89 ppm. It was thus found that nitriding occurred during casting to cause formation of abundant AlN.

The inventors next prepared 2.0-mm thick cast strips by using the twin-roll process to rapidly solidify steel melts containing C: 0.0011 to 0.0012%, Si: 3.0%, Al: 1.4%, Mn: 0.24%, S: 0.0022 to 0.0025%, N: 0.0021 to 0.0023%, Ti: 0.0015%, Cu: 0.09% and T.O: 0.0032% in different casting atmospheres. The results were cold-rolled to a thickness of 0.35 mm and subjected to 1050° C.×30 s finish-annealing in a 70% $N_2$+30% $H_2$ atmosphere. The cast strips were analyzed for N. The results are shown in Table 1. It was thus found that N in the cast strip was markedly increased by nitriding occurring during casting when the casting atmosphere was $N_2$ or air but that nitriding was inhibited when the casting atmosphere was Ar or He.

TABLE 1

| Casting atmosphere | Melt N (ppm) | Cast strip N (ppm) |
|---|---|---|
| 100% $N_2$ | 21 | 89 |
| Air | 21 | 88 |
| 100% Ar | 23 | 23 |
| 100% He | 22 | 22 |

The thickness center layers of specimens of the cast strip cast in the Ar atmosphere and its finish-annealed sheet were examined for precipitates using an electron microscope. The cast strip had few precipitates, with only a small number of AlN precipitates of micron size and Mn—Cu—S precipitates in the approximate size range of several tens of nanometers to one hundred nanometers being observed. However, the finish-annealed sheet had more micron-sized AlN precipitates and notably more Mn—Cu—S precipitates on the size order of several tens of nanometers than the cast strip, and large numbers of the latter were observed. From this it was concluded that the rapid cooling rate of the rapid solidification process leads to most solute S being present in the cast strip as solute S that during finish-annealing is precipitated as fine Mn—Cu—S on the size order of several tens of nanometers.

The inventors therefore carried out a study regarding S control, from which they learned that incorporation of REM and Ca in the melt is very effective for this purpose. They prepared 2.0-mm thick cast strips by using the twin-roll process to rapidly solidify steel melts containing C: 0.0010%, Si: 3.0%, Al: 1.4%, Mn: 0.24%, S: 0.0025%, N: 0.0022%, Ti: 0.0019%, Cu: 0.08%, T.O: 0.0022%, and various amounts of REM in Ar and $N_2$ casting atmospheres. The results were cold-rolled to a thickness of 0.35 mm and subjected to 1050° C.×30 s finish-annealing in a 70% $N_2$+30% $H_2$ atmosphere. The thickness center layers of the cast strips cast in the Ar atmosphere and their finish-annealed sheets were examined for precipitates using an electron microscope. The precipitation patterns of the cast strips and the finish-annealed sheets were the same and were dominated by $REM_2O_2S$ with complex-precipitated AlN of micron size. Almost no precipitates on the size order of several tens of nanometers were observed. From this it was discovered that when REM is added, $REM_2O_2S$ crystallizes in the melt to scavenge S and, in addition, complex precipitation of AlN and TiN occurs at these sites, thereby preventing appearance of fine, independent AlN. FIG. 1 shows how core loss 15/50 varies with REM content and casting atmosphere. It can be seen that when REM content is 20 to 100 ppm and casting is conducted in an Ar casting atmosphere, core loss decreases considerably. In another experiment, it was ascertained that a similar effect can be obtained with Ca.

Continuing their investigation, the inventors examined specimens of finish-annealed sheets containing REM at 35 ppm and observed precipitates at the surface region. Upon observation and analysis using an electron microscope, the precipitates were found to be fine AlN. They also observed cast strip but found nothing similar, meaning that the fine AlN was formed by nitriding during finish-annealing. They therefore prepared 2.0-mm thick cast strips by using the twin-roll process to rapidly solidify steel melts containing C: 0.0008%, Si: 3.0%, Al: 1.4%, Mn: 0.23%, S: 0.0020%, N: 0.0019%, Ti: 0.0017%, Cu: 0.08%, T.O: 0.0022%, REM: 0.0030%, and Sn: 0% (no Sn) or 0.03% in an Ar casting atmosphere. The results were cold-rolled to a thickness of 0.35 mm and subjected to 1050° C.×30 s finish-annealing in a 70% $N_2$+30% $H_2$ atmosphere. The finish-annealed sheets were measured for core loss W15/50 and their surface regions were observed with an electron microscope. In the case of 0.03% Sn addition, no surface AlN was observed and W15/50 was 1.89 W/kg. In the case of no Sn addition, surface AlN formed by nitriding was observed and W15/50 was 1.92 W/kg. Addition of Sn was thus found to inhibit nitriding and thereby further improve core loss property. It is thought that when REM is added, it scavenges S as $REM_2O_2S$, so that surface segregation of S ceases, but nitriding occurs, and when Sn is added, Sn segregates at the surface to effectively control nitriding. In another experiment, it was ascertained that a similar effect can be obtained with Sb.

The reasons for defining the chemical composition of the steel will be explained first. Unless otherwise indicated, the symbol % used with respect to element content indicates mass %.

C content is defined as 0.003% or less in order avoid the austenite+ferrite two-phase region and obtain a single ferrite phase enabling maximum growth of columnar grains. C content is also defined as 0.003% or less so as to inhibit precipitation of fine TiC.

Under conditions of Si: 1.5 to 3.5%, Al: 0.2 to 3.0%, 1.9%≦(% Si+% Al), and C is 0.003% or less, the austenite+ferrite two-phase region is avoided to obtain a single ferrite phase insofar as 1.9%≦(% Si+% Al). So the invention stipulates 1.9%≦(% Si+% Al). Since Si and Al reduce eddy current loss by increasing electrical resistance, their lower content limits are defined as 1.5% and 0.2%, respectively. Addition of Si and Al in excess of 3.5% and 3.0%, respectively, markedly degrades workability.

Mn content is defined as 0.02% or greater in order to improve brittleness property. Addition in excess of the upper limit of 1.0% degrades magnetic flux density.

S forms sulfides that exhibit a harmful effect on core loss property. S content is therefore defined as 0.0030% or less.

N forms AlN, TiN and other fine nitrides that exhibit a harmful effect on core loss property. N content is therefore defined as 0.2% or less, preferably 0.00300% or less.

Ti forms TiN, TiC and other fine precipitates that exhibit a harmful effect on core loss property. Ti content is therefore defined as 0.0050% or less.

Cu forms Mn—Cu—S and other fine sulfide that exhibit a harmful effect on core loss property. Cu content is therefore defined as 0.2% or less.

T.O is added to form as much $REM_2O_2S$ and Ca—O—S as possible, thereby scavenging S and promoting coarse complex precipitation of AlN and TiN. For this purpose, the lower limit of T.O content is defined as 0.001%. When the content exceeds the upper limit of 0.005%, $Al_2O_3$ forms to make complex precipitation of AlN and TiN difficult.

REM and Ca are added individually or in combination to a total content of 0.002 to 0.01%. The lower limit is defined as 0.002% in order to form as much $REM_2O_2S$ and Ca—O—S as possible, thereby scavenging S and promoting coarse complex precipitation of AlN and TiN. For this purpose, the lower limit of total REM and Ca content is defined as 0.002%. When the content exceeds the upper limit of 0.01%, magnetic properties deteriorate rather than improve. REM is used as a collective term for the 17 elements consisting of the 15 elements from lanthanum to lutetium, plus scandium and yttrium. Insofar as the amount added is within the range prescribed by the present invention, the aforesaid effect of REM can be realized by any one of the elements individually or by a combination of two or more thereof. REM and Ca can be used individually or in combination.

Sn and Sb are added individually or in combination to a total content of 0.005 to 0.3%. Sn and Sb segregate at the surface where they inhibit nitriding during finish annealing. They do not inhibit nitriding at a content of less than 0.005% and their effect saturates at a content exceeding the upper limit of 0.3%. Addition of Sn and Sb not only inhibits nitriding but also improves magnetic flux density. Sn and Sb can be used individually or in combination.

The steel melt is solidified using a traveling cooling roll surface(s) to obtain a cast steel strip. A single-roll caster, twin-roll caster or the like can be used.

The casting atmosphere is Ar, He or a mixture thereof. Nitriding occurs during casting when an $N_2$ or air atmosphere is used. This is prevented by use of Ar, He or a mixture thereof.

EXAMPLES

First Set of Examples

Steel melts containing C: 0.0012%, Si: 3.0%, Mn: 0.22%, Sol. Al: 1.4%, S: 0.0015 to 0.0018%, N: 0.0019 to 0.0025%, T.O: 0.0020 to 0.0025%, Ti: 0.0012 to 0.0015%, Cu: 0.08%, and REM: 0.0025% were each cast to a thickness of 2.0 mm by rapid solidification in a different casting atmosphere using the twin-roll process. The result was pickled, cold rolled to 0.35 mm, subjected to continuous annealing of 1075° C.×30 s in a 70% $N_2$+30% $H_2$ atmosphere, and coated with an insulating film to obtain a product. The relationship among casting atmosphere, melt N, cast strip N and magnetic properties in this case is shown in Table 2. It can be seen that use of Ar, He or a mixture thereof as the casting atmosphere made it possible to achieve high magnetic flux density and low core loss.

TABLE 2

| No. | Casting atmosphere | Melt N (ppm) | Cast strip N (ppm) | W15/50 (W/kg) | B50 (T) | Remark |
|---|---|---|---|---|---|---|
| 1 | 100% $N_2$ | 22 | 87 | 2.16 | 1.700 | Comparative Example |
| 2 | Air | 23 | 85 | 2.32 | 1.699 | Comparative Example |
| 3 | 50% Ar + 50% $N_2$ | 23 | 86 | 2.17 | 1.699 | Comparative Example |
| 4 | 50% He + 50% $N_2$ | 22 | 88 | 2.17 | 1.701 | Comparative Example |
| 5 | 100% Ar | 21 | 21 | 1.95 | 1.725 | Invention Example (Claim 1) |
| 6 | 100% He | 24 | 24 | 1.94 | 1.726 | Invention Example (Claim 1) |
| 7 | 10% Ar + 90% He | 22 | 22 | 1.95 | 1.725 | Invention Example (Claim 1) |
| 8 | 25% Ar + 75% He | 24 | 24 | 1.94 | 1.726 | Invention Example (Claim 1) |
| 9 | 50% Ar + 50% He | 23 | 23 | 1.94 | 1.725 | Invention Example (Claim 1) |
| 10 | 75% Ar + 25% He | 21 | 21 | 1.95 | 1.726 | Invention Example (Claim 1) |
| 11 | 90% Ar + 10% He | 24 | 24 | 1.95 | 1.725 | Invention Example (Claim 1) |

Second Set of Examples

Steel melts containing C: 0.0011%, Si: 3.0%, Mn: 0.25%, Sol. Al: 1.4%, N: 0.0022 to 0.0028%, Ti: 0.0014 to 0.0015%, Cu: 0.11%, T.O, S, REM and Ca were each cast to a thickness of 2.0 mm by rapid solidification in an Ar casting atmosphere using the twin-roll process. The result was pickled, cold rolled to 0.35 mm, subjected to continuous annealing of 1075° C.×30 s in a 70% $N_2$+30% $H_2$ atmosphere, and coated with an insulating film to obtain a product. The relationship between T.O, S, REM and Ca contents and magnetic properties at this time is shown in Table 3. It can be seen that high magnetic flux density and low core loss were obtained within the invention content ranges.

TABLE 3

| No. | O (ppm) | S (ppm) | REM (ppm) | Number of REM elements added | Ca (ppm) | W15/50 (W/kg) | B50 (T) | Remark |
|---|---|---|---|---|---|---|---|---|
| 1 | 25 | 8 | — | — | — | 2.12 | 1.705 | Comparative Example |
| 2 | 25 | 8 | 12 | 1 | — | 2.08 | 1.699 | Comparative Example |
| 3 | 22 | 9 | 22 | 1 | — | 1.95 | 1.725 | Invention Example (Claim 1) |
| 4 | 23 | 10 | 55 | 1 | — | 1.87 | 1.726 | Invention Example (Claim 1) |
| 5 | 22 | 13 | 83 | 1 | — | 1.89 | 1.725 | Invention Example (Claim 1) |
| 6 | 22 | 12 | 97 | 1 | — | 1.90 | 1.725 | Invention Example (Claim 1) |
| 7 | 21 | 12 | 105 | 1 | — | 2.01 | 1.698 | Comparative Example |
| 8 | 7 | 15 | 33 | 1 | — | 2.09 | 1.699 | Comparative Example |
| 9 | 53 | 12 | 34 | 1 | — | 2.12 | 1.695 | Comparative Example |
| 10 | 20 | 29 | 30 | 1 | — | 1.88 | 1.726 | Invention Example (Claim 1) |

TABLE 3-continued

| No. | O (ppm) | S (ppm) | REM (ppm) | Number of REM elements added | Ca (ppm) | W15/50 (W/kg) | B50 (T) | Remark |
|---|---|---|---|---|---|---|---|---|
| 11 | 20 | 34 | 32 | 1 | — | 2.00 | 1.699 | Comparative Example |
| 12 | 29 | 21 | — | — | 16 | 2.01 | 1.699 | Comparative Example |
| 13 | 28 | 22 | — | — | 50 | 1.94 | 1.725 | Invention Example (Claim 1) |
| 14 | 27 | 21 | — | — | 98 | 1.95 | 1.725 | Invention Example (Claim 1) |
| 15 | 27 | 20 | — | — | 103 | 2.21 | 1.697 | Comparative Example |
| 16 | 25 | 23 | 25 | 1 | — | 1.87 | 1.726 | Invention Example (Claim 1) |
| 17 | 26 | 22 | 44 | 2 | — | 1.86 | 1.725 | Invention Example (Claim 1) |
| 18 | 27 | 21 | 58 | 3 | — | 1.88 | 1.726 | Invention Example (Claim 1) |
| 19 | 26 | 22 | 47 | 2 | 33 | 1.87 | 1.725 | Invention Example (Claim 1) |

Third Set of Examples

Steel melts containing C: 0.0010%, Si: 2.9%, Mn: 0.20%, S: 0.0019 to 0.0022%, Sol. Al: 1.2%, N: 0.0019 to 0.0029%, Ti: 0.0012 to 0.0013%, Cu: 0.11%, T.O: 0.0011 to 0.0016%, REM: 0.0080 to 0.0085%, Sn and Sb were each cast to a thickness of 2.0 mm by rapid solidification in an Ar casting atmosphere using the twin-roll process. The result was pickled, cold rolled to 0.35 mm, subjected to continuous annealing of 1075° C.×30 s in a 70% $N_2$+30% $H_2$ atmosphere, and coated with an insulating film to obtain a product. The relationship among Sn and Sb contents, presence/absence of finish-annealed surface nitriding and magnetic properties in this case is shown in Table 4. It can be seen that when Sn and Sb contents were within the invention content ranges, high magnetic flux density and low core loss were realized owing to nitriding inhibition.

TABLE 4

| No. | Sn (%) | Sb (%) | Nitriding of finish-annealed sheet surface? | W15/50 (W/kg) | B50 (T) | Remark |
|---|---|---|---|---|---|---|
| 1 | — | — | Yes | 2.01 | 1.723 | Invention Example (Claim 1) |
| 2 | 0.003 | — | Yes | 2.00 | 1.724 | Invention Example (Claim 1) |
| 3 | 0.005 | — | No | 1.98 | 1.727 | Invention Example (Claim 2) |
| 4 | 0.035 | — | Yes | 1.97 | 1.728 | Invention Example (Claim 2) |
| 5 | 0.3 | — | Yes | 1.97 | 1.728 | Invention Example (Claim 2) |
| 6 | — | 0.003 | Yes | 2.01 | 1.724 | Invention Example (Claim 1) |
| 7 | — | 0.005 | Yes | 1.99 | 1.727 | Invention Example (Claim 2) |

TABLE 4-continued

| No. | Sn (%) | Sb (%) | Nitriding of finish-annealed sheet surface? | W15/50 (W/kg) | B50 (T) | Remark |
|---|---|---|---|---|---|---|
| 8 | — | 0.045 | Yes | 1.97 | 1.728 | Invention Example (Claim 2) |
| 9 | — | 0.3 | Yes | 1.97 | 1.728 | Invention Example (Claim 2) |
| 10 | 0.01 | 0.01 | Yes | 1.97 | 1.728 | Invention Example (Claim 2) |

INDUSTRIAL APPLICABILITY

The present invention provides a non-oriented electrical steel sheet with high magnetic flux density and low core loss that is suitable for use in the cores of rotating machines, small static electric devices and the like.

What is claimed is:

1. A method of producing non-oriented electrical steel sheet excellent in magnetic properties, the method comprising the steps of:

obtaining a cast steel strip by using a traveling cooling roll surface or surfaces to solidify a steel melt, the steel melt consisting of, in mass %, C: 0.003% or less, Si: 1.5 to 3.5%, Al: 0.2 to 3.0%, 1.9%≦(% Si+% Al), Mn: 0.02 to 1.0%, S: 0.0030% or less, N: 0.2% or less, Ti: 0.0012 to 0.0050%, Cu: 0.2% or less, total amount of oxygen: 0.001 to 0.005%, a total content of one or both of Sn and Sb: 0.005 to 0.3%, a total content of one or both of REM and Ca of 0.0020 to 0.01% and a balance of Fe and unavoidable impurities, cold-rolling the cast steel strip, and finish-annealing the cold-rolled steel strip, and the steel melt is cast in an atmosphere of Ar, He or a mixture thereof.

* * * * *